United States Patent [19]

Donarumma et al.

[11] 4,278,691

[45] Jul. 14, 1981

[54] COFFEE INFUSION BAG

[76] Inventors: Angelo Donarumma, 469-15 St., West Babylon, N.Y. 11704; Thomas Callahan, 7 Cynthia La., East Islip, N.Y. 11730

[21] Appl. No.: 130,700

[22] Filed: Mar. 17, 1980

[51] Int. Cl.[3] ..... B65B 29/02; B65B 29/04

[52] U.S. Cl. ..... 426/80; 206/0.5; 426/83

[58] Field of Search ..... 426/77–84, 426/394, 115; 206/0.5

[56] References Cited

U.S. PATENT DOCUMENTS

| | | | |
|---|---|---|---|
| 1,976,497 | 10/1934 | Higgins | 426/83 |
| 2,123,054 | 7/1938 | Lamb et al. | 426/80 |
| 2,377,118 | 5/1945 | Weisman | 426/82 |
| 3,193,388 | 7/1965 | Conrey | 426/77 |
| 3,384,492 | 5/1968 | Spencer | 426/83 |
| 3,415,656 | 12/1968 | Lundgren | 426/81 |
| 3,420,675 | 1/1969 | Costas | 426/77 |
| 3,556,392 | 1/1971 | Robin | 426/83 |
| 3,579,351 | 5/1971 | Wege et al. | 426/82 |
| 3,597,222 | 8/1971 | Kalemba | 426/83 |
| 3,607,302 | 9/1971 | Beck | 426/83 X |
| 3,767,420 | 10/1973 | Kim | 426/77 |

FOREIGN PATENT DOCUMENTS

| | | | |
|---|---|---|---|
| 999409 | 10/1949 | France | 426/82 |

*Primary Examiner*—Steven L. Weinstein

*Attorney, Agent, or Firm*—Marvin Feldman; Stephen E. Feldman

[57] ABSTRACT

An infusion bag is disclosed wherein granular coffee is contained in a water-permeable portion which is attached to a water-reservoir portion whereby water passes downwardly in a positive manner from the reservoir into the receptacle to contact the granules and then the coffee brew is passed outwardly from the receptacle. Strings attached to the receptacle permit positive opening and closing of the receptacle with positive water action through the bag. The infusion bag is particularly suited to brewing coffee from ground coffee beans.

10 Claims, 4 Drawing Figures

COFFEE INFUSION BAG

FIELD OF THE INVENTION

This invention relates to infusion bags. Specifically, this invention relates to an infusion bag for making a brew with hot water.

BACKGROUND AND DISCUSSION OF PRIOR ART

Various infusion bag designs have been attempted such as are disclosed in U.S. Pat. No. 3,208,854 to Hediger et al; U.S. Pat. No. 3,597,222 to Kalemba; U.S. Pat. No. 3,092,439 to Harrison and U.S. Pat. No. 1,581,578 to Kieselback.

While the use of tea in infusion bags has achieved widespread use, the use of infusion bags for coffee has not to date been widely accepted. One of the reasons for this was that the coffee would not readily impart its brew in hot water through the normal infusion forces of a conventional bag. Thus, the coffee was never sufficiently strong so as to be an acceptable product.

Now there is provided by the present invention an infusion bag of a novel construction whereby the water passes through the coffee in a positive manner so as to provide a sufficiently strong coffee brew.

It is therefore a principal object of the present invention to provide an improved infusion bag.

It is a further object of the present invention to provide an infusion bag as aforesaid which provides a strong coffee brew.

It is a further object of the present invention to provide an infusion bag which permits positive interaction of hot water with ground coffee.

It is a still further object of the present invention to provide an infusion bag which gives a positive action with the dunking action of the bag in hot water.

It is a yet further object of this invention to provide an infusion bag which can be substantially entirely formed of infusion paper, and which is of low cost construction, and yet readily practical in design and use.

The aforesaid as well as other objects and advantages will become apparent from a reading of the following description, the adjoined claims, and the drawings in which:

IN THE DRAWINGS

DESCRIPTION OF THE PREFERRED EMBODIMENT

Figure 1:
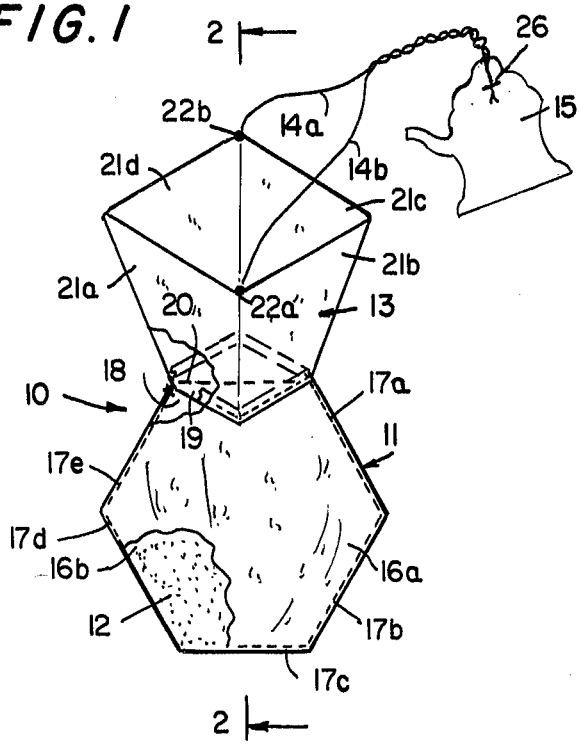
FIG. 1 is a perspective view of the coffee infusion bag of the present invention, shown in condition for receiving water.

Referring to the FIGS., the infusion bag of the present invention is generally referred to as numeral 10. Bag 10 comprises in a broad sense, a coffee receptacle portion 11 containing ground coffee 12, a reservoir portion 13 attached to the receptacle portion 11 into which the water is received a pair of strings 14*a*, 14*b*, and a tag 15.

Receptacle portion 11 is formed of opposed hexagonal sheets 16*a*, 16*b*, formed of infusion paper. The sheets 16*a* and 16*b* are joined on five sides 17*a*–17*e* so as to leave a top opening 18. Opening 18 is covered over by sheet of infusion paper 19 which is sealed in the opening so as to enclose the coffee in the receptacle portions. Sheet 19 is folded at pre-scored line 20 for reasons hereinafter appearing.

Reservoir portion 13 comprises a cup-like construction of four sides 21*a*–21*d*, wherein the bottom of the cup is enclosed by infusion sheet section 19 which is bonded to sides 21*a*–21*d*, thus forming a cup.

Strings 14*a* and 14*b* are attached at one pair of ends to sides 21*a*–21*d* as at 22*a* and 22*b* respectively. The other string ends are mounted to cardboard member or tag 15 by a staple 26 in the well known manner.

Figure 2:
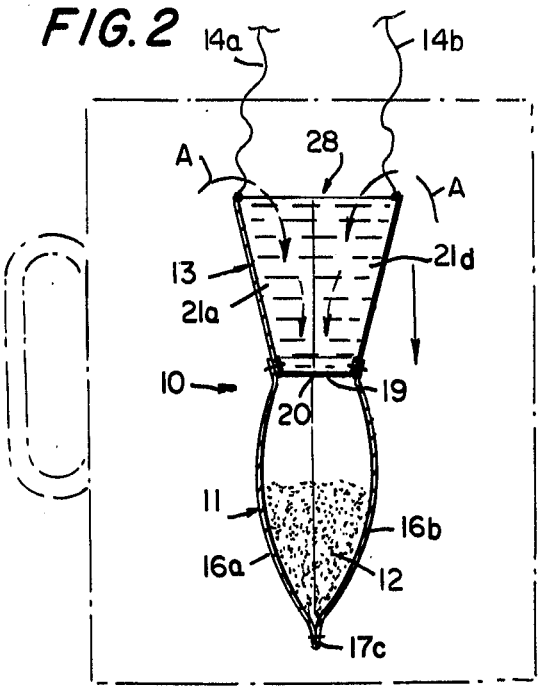
FIG. 2 is a sectional view taken along line 2—2 of FIG. 1.
Figure 3:
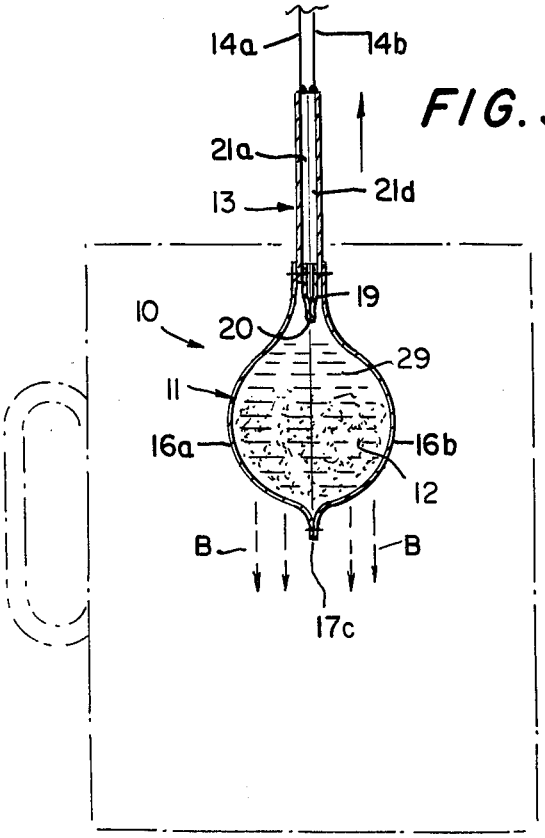
FIG. 3 is a sectional view as in FIG. 2, but with the water passing through the infusion bag.
Figure 4:
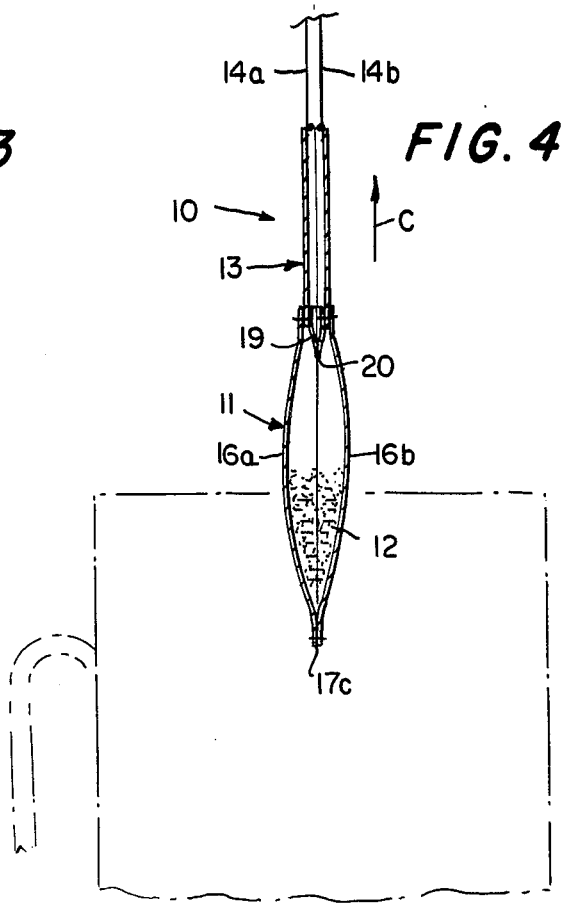
FIG. 4 is a sectional view as in FIG. 3, but after the water has passed through the bag.

In the aforesaid manner of construction the bag 10 may be lowered into a cup of hot water (FIG. 2) whereat the water more freely moves into the top opening 28 of the reservoir while less freely permeating the bag sides. The broken arrows A of FIG. 2 depict this biased water flow into the reservoir 13. The strings 14*a* and 14*b* are in a relaxed condition with the bag being bouyed by the water. Once the water fills the reservoir 13, the strings are pulled upwardly to a taut condition (FIG. 3), and the water is moved by reaction of this motion and under the force of gravity through the infusion paper portion 19 into the receptacle portion 11 to fill the bag with water 29 and to contact the coffee 12. With the bag lifted out of the cup, the water in the bag then passes outwardly from the bottom of the bag, broken line arrows B of FIG. 3. With the collapsing of sides 21*a*–21*d*, portion 19 folds on itself and prevents backflow from the receptacle portion to the reservoir. With further lifting of the bag as shown by arrow C in FIG. 4, the receptacle portion is drained of its fresh coffee brew and ready for reinsertion. With reinsertion and further dunking, the reservoir opens to again receive another slug of water.

It has surprisingly been found that with the receptacle containing about ½ to 1½ teaspoons of fresh ground coffee, only 8 dunks of the bag may be required to obtain a moderately strong brew in a single cup. Of course, with more dunks the brew strength increases. The sides of the bag as shown need only be ¾"–1" in length. The bag may be entirely formed of water-permeable sheeting such as infusion paper, which paper is well known in the art, and sheets of the paper are attached by well known means.

It is to be borne in mind that while the bag of this invention is particularly suited to brewing coffee, other drink substances, particularly those in which it is normally difficult to effect a liquid solid extraction are also suitable, such as certain herbal teas, and the like.

It is also to be noted that the hexagonal receptacle shape in combination with the reservoir permits a high volume slug of water to be passed through the limited quantity of coffee granules with each dunking. The limited coffee requirement makes the specific construction particularly desirable, and is less costly than instant coffee while avoiding the waste of conventional coffee makers.

In accomplishing the desired results that are set forth in the objects and advantages of the present invention, and as described in detail in the foregoing description, it will be perceived and obvious that the invention is suceptible to some changes and modifications, without departing from the principle and spirit thereof. For this reason, the terminology used in the specification is for the purpose of description and not limitation, the scope of the invention being defined in the claims.

What is claimed is:

1. An infusion bag comprising a receptacle portion containing infusion solids and formed of water permeable sheet material, and a reservoir portion including an open top, side walls and a lower water permeable sheet, the lowest portion of said reservoir side walls being attached to the uppermost part of the receptacle portion so that the reservoir portion is disposed substantially above the receptacle portion and said water permeable sheet is disposed above and spaced from the infusion solids; the reservoir portion including fold means and string means attached to said uppermost part of the reservoir portion, said fold means and string means combining to open and close the reservoir portion to the inflow of water when the string means is in a relaxed condition and a taut condition, respectively, the string means being in a relaxed condition with the bag being buoyed when the bag is lowered into a cup of hot water wherein the water freely moves into said open top of said reservoir portion and the string means being taut when they are pulled upwardly thus assisting in the movement of the water from the filled reservoir portion down through said lower water permeable sheet and through said lower water permeable sheet and through the receptacle portion so as to extract a water soluble brew from the solids.

2. The infusion bag of claim 1, said solids comprising coffee granules, and wherein said granules are prevented from entering the reservoir portion by said lower water permeable sheet.

3. The infusion bag of claim 1, said sheet material being formed with lower water permeable sheet fold means whereby on pulling the string means upwardly the lower water permeable sheet folds.

4. The infusion bag of claim 3, wherein the receptacle portion expands with collapsing of the reservoir portion and folding of the lower water permeable sheet.

5. The infusion bag of claim 3, said string means comprising a pair of strings with ends attached to the reservoir portion adjacent the open top, and the lower water permeable sheet fold means being formed so that said string ends are disposed on opposite sides of the fold.

6. The infusion bag of claim 1, wherein the receptacle portion comprises opposing sheets of hexagonal shape being joined at the hexagonal sides wherein the brew passes outwardly from said sides with the collapsing of the reservoir.

7. The infusion bag of claim 1, said reservoir portion being formed with said fold means so that the reservoir portion collapses inwardly with the pulling of the string means so as to force the water into the receptacle portion.

8. The infusion bag of claim 7, said string means comprising a pair of strings, one pair of ends of the strings being attached to opposide sides of the receptacle portion, and the other pair of ends being disposed adjacent each other.

9. The infusion bag of claim 1, said receptacle and said reservoir portions being formed substantially entirely of water-permeable sheets.

10. The infusion bag of claim 9, said sheets comprising infusion paper.

* * * * *